US006968885B2

(12) United States Patent
Nien

(10) Patent No.: US 6,968,885 B2
(45) Date of Patent: Nov. 29, 2005

(54) VENETIAN BLIND THAT KEEPS LIFT CORDS CONCEALED

(75) Inventor: Ming Nien, Changhua Hsien (TW)

(73) Assignee: Nien Made Enterprise Co., Ltd. (TW)

( * ) Notice: Subject to any disclaimer, the term of this patent is extended or adjusted under 35 U.S.C. 154(b) by 167 days.

(21) Appl. No.: 10/282,063

(22) Filed: Oct. 29, 2002

(65) Prior Publication Data

US 2004/0031575 A1 Feb. 19, 2004

(30) Foreign Application Priority Data

Aug. 19, 2002 (TW) ..... 91212840 U

(51) Int. Cl.[7] ..... E06B 9/30
(52) U.S. Cl. ..... 160/172 R; 160/84.06
(58) Field of Search ..... 160/173 R, 168.1 R, 160/178.1 R, 178.3 R, 172 R, 276

(56) References Cited

U.S. PATENT DOCUMENTS 1,994,194 A * 3/1935 Fisher ..... 160/172 R
4,685,502 A * 8/1987 Spangenberg ..... 160/107
4,768,576 A * 9/1988 Anderson ..... 160/107
5,332,021 A * 7/1994 Todd et al. ..... 160/133
6,688,372 B1 * 2/2004 Nien ..... 160/172 R
6,705,379 B1 * 3/2004 Nien ..... 160/172 R

* cited by examiner

*Primary Examiner*—Blair M. Johnson
(74) *Attorney, Agent, or Firm*—Bacon & Thomas, PLLC

(57) ABSTRACT

A Venetian blind. The blind includes a horizontal headrail, two vertical side rails arranged in parallel at two sides below the headrail, and a horizontal bottom rail spaced below the headrail and vertically movable along the length of the side rails. Slats are, arranged in parallel between the headrail and the bottom rail. Two connecting cord members are longitudinally connected to the slats and each having two ends respectively connected to the headrail and the bottom rail. Two positioning mechanisms are provided between the side rails and the ends of the bottom rail and adapted to secure the ends of the bottom rail to the side rails at the desired elevation.

8 Claims, 10 Drawing Sheets

VENETIAN BLIND THAT KEEPS LIFT CORDS CONCEALED

FIELD OF THE INVENTION

The present invention relates to Venetian blinds and, more specifically, to such a safety Venetian blind that keeps the cord members concealed and out of reach of children.

DESCRIPTION OF THE RELATED ART

A regular Venetian blind is generally comprised of a top rail, a bottom rail, a plurality of slats arranged in parallel between the top rail and the bottom rail, a lift control mechanism for controlling lifting and positioning of the bottom rail to adjust the extending area of the Venetian blind, and a tilting control mechanism for controlling the tiling angle of the slats to regulate the light. The lift control mechanism comprises a lift cord suspended from the top rail at one side for operation by hand to control the elevation of the bottom rail. Because the lift cord is exposed to the outside, it destroys the sense of beauty of the Venetian blind. Further, because a child can easily reach the exposed lift cord, an accident may occur when a child pulling the lift cord for fun. In order to eliminate this problem, Venetian blinds with receivable lift cord(s) are developed. However, these Venetian blinds are commonly have a complicated structure and high manufacturing cost.

SUMMARY OF THE INVENTION

The present invention has been accomplished to provide a safety Venetian blind, which eliminates the aforesaid drawbacks. It is the main object of the present invention to provide a Venetian blind.

It is another object of the present invention to provide a Venetian blind, which enables the user to control the lifting and positioning of the slats easily.

It is still another object of the present invention to provide a Venetian blind, which has a simple structure and, is inexpensive to manufacture.

To achieve these objects of the present invention, the Venetian blind comprises a horizontal headrail, two vertical side rails arranged in parallel at two sides below the headrail, a horizontal bottom rail spaced below the headrail and vertically movable along the length of the side rails, a plurality of slats arranged in parallel between the headrail and the bottom rail, two connecting cord members longitudinally connected to the slats and each having two ends respectively connected to the headrail and the bottom rail, and two positioning mechanisms provided between the side rails and the ends of the bottom rail and adapted to secure the ends of the bottom rail to the side rails at the desired elevation.

According to one embodiment of the present invention, the positioning mechanisms can be respectively comprised of two magnetically attractive members connectable to each other by magnetic attraction. Alternatively, each positioning mechanism can be comprised of a tape of loop material and a tape of hook material.

DETAILED DESCRIPTION OF THE PREFERRED EMBODIMENT

Figure 1:
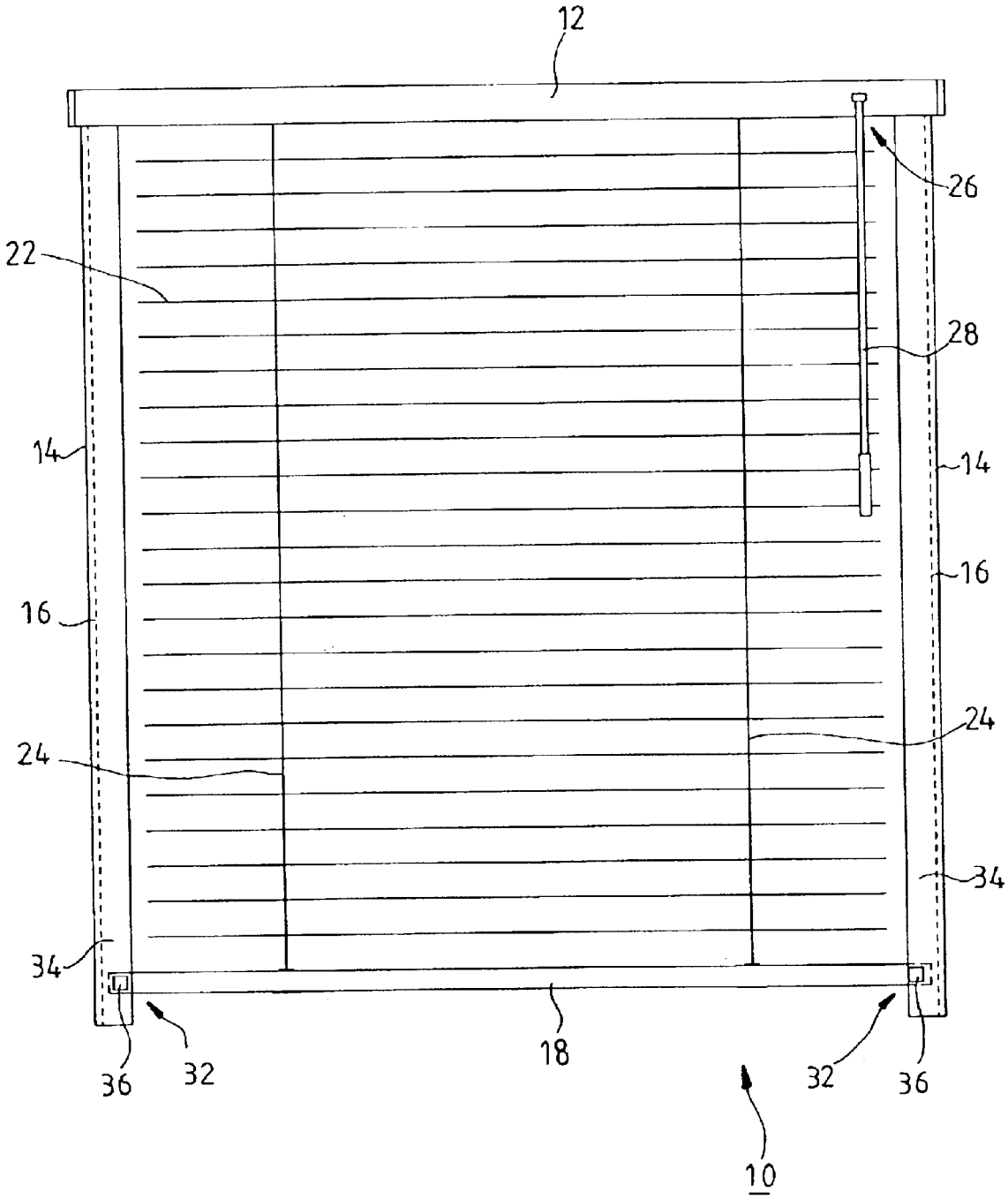
FIG. 1 is a front view of the first preferred embodiment of the present invention, showing the Venetian blind fully extended out.
Figure 2:
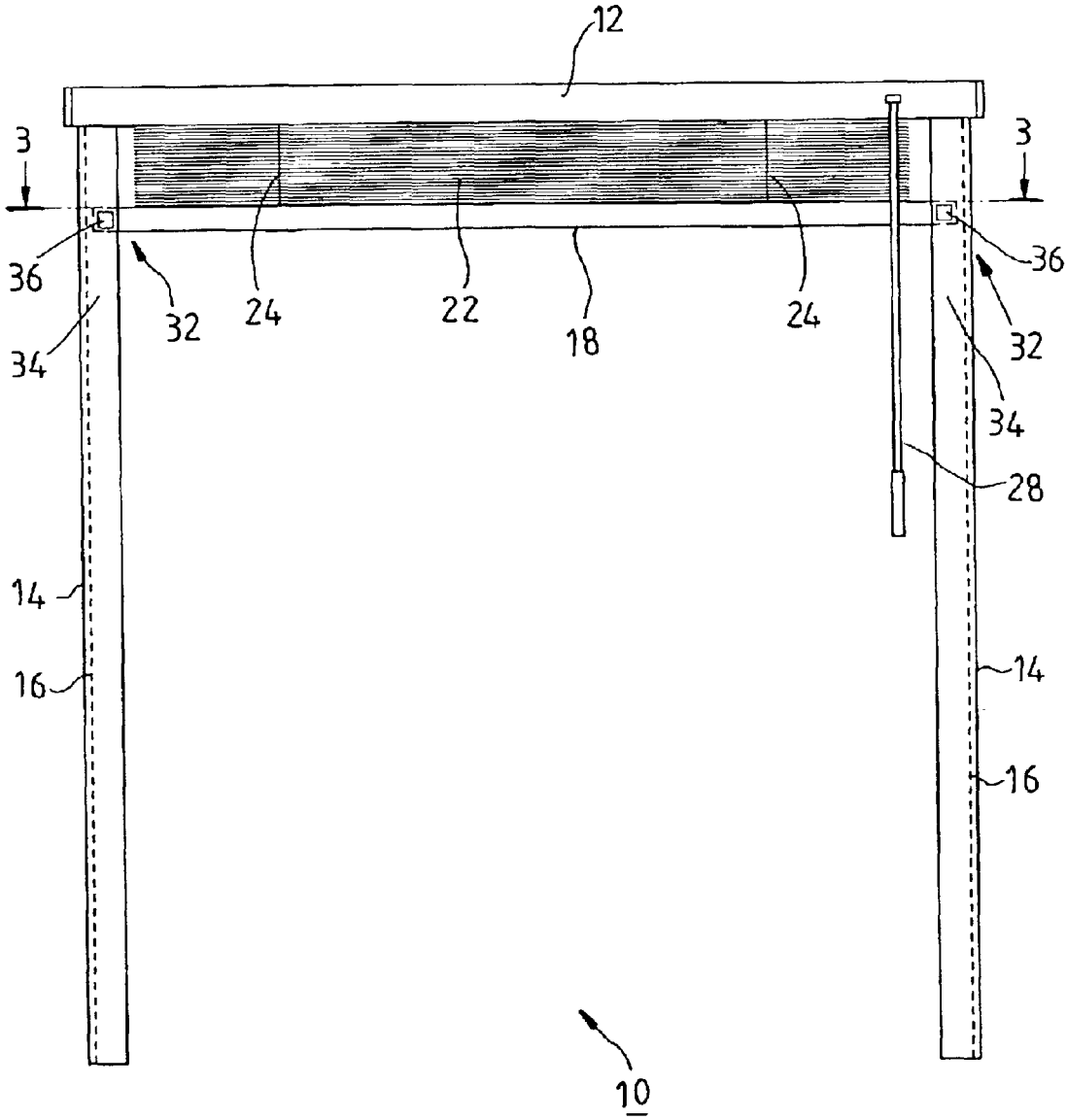
FIG. 2 is similar to FIG. 1, but showing the Venetian blind fully received.

Referring to FIGS. 1 and 2, a Venetian blind 10 is shown comprising, a headrail 12, two side rails 14, a bottom rail 18, a set of slats 22, two connecting cords 24, a tilting control mechanism 26, and two positioning mechanisms 32.

The headrail 12 is transversely (horizontally) fixedly provided at the topside of the window.

Figure 3:
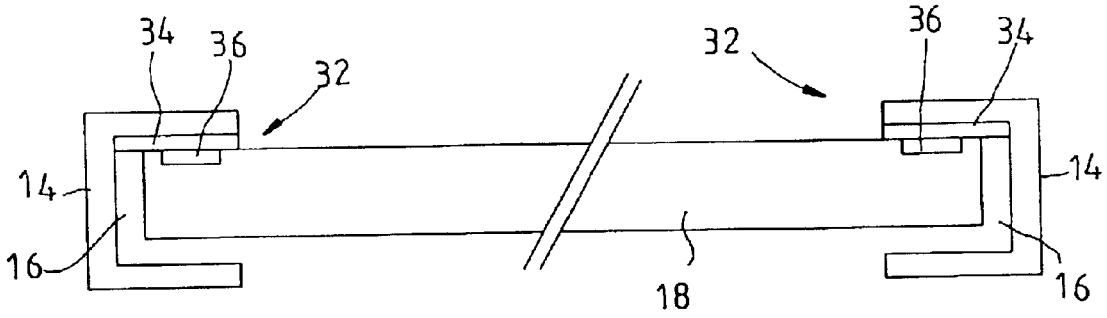
FIG. 3 is a sectional view taken along line 3—3 of FIG. 2, showing the ends of the bottom rail secured to the side rails.

The side rails 14 are longitudinally (vertically) fixedly provided at the left and right sides of the window. As illustrated in FIG. 3, the side rails 14 each have a longitudinal sliding groove 16 facing each other.

The bottom rail 14 is transversely (horizontally) spaced below the headrail 12, having two distal ends respectively perpendicularly inserted into the longitudinal sliding grooves 16 of the side rails 14. The width of the bottom rail 14 is smaller than the width of the longitudinal sliding grooves 16 of the side rails 14, so that the bottom rail 14 can be moved along the longitudinal sliding grooves 16 of the side rails 14 to the desired elevation (see FIGS. 3 and 4).

The slats 22 are arranged in parallel between the headrail 12 and the bottom rail 18.

The connecting cords 24 are longitudinally (vertically) connected in parallel between the headrail 12 and the bottom rail 18 to hold the slats 22 in parallel. According to this embodiment, the connecting cords 24 are ladder tapes, i.e., each connecting cord 24 is formed of two main cords respectively and longitudinally extended over the front and back sides of the slats 22 and a plurality of supplementary cords respectively transversely connected between the two main cords and respectively joining one slat 22. Therefore, the tilting angle of the slats 22 is relatively changed when lifting or lowering one of the main cords.

The tilting control mechanism 26 is of the known art and adapted to control the tilting angle of the slats 22. Only the tilt rod 28 is shown in the drawings. When rotating the tilt rod 28, the two main cords of each connecting cord 24 are relatively moved in reversed direction to tilt the slats 22.

Because the tilting control mechanism is of the known art and not within the scope of the claims of the present invention, no further detailed description is necessary in this regard.

Figure 4:
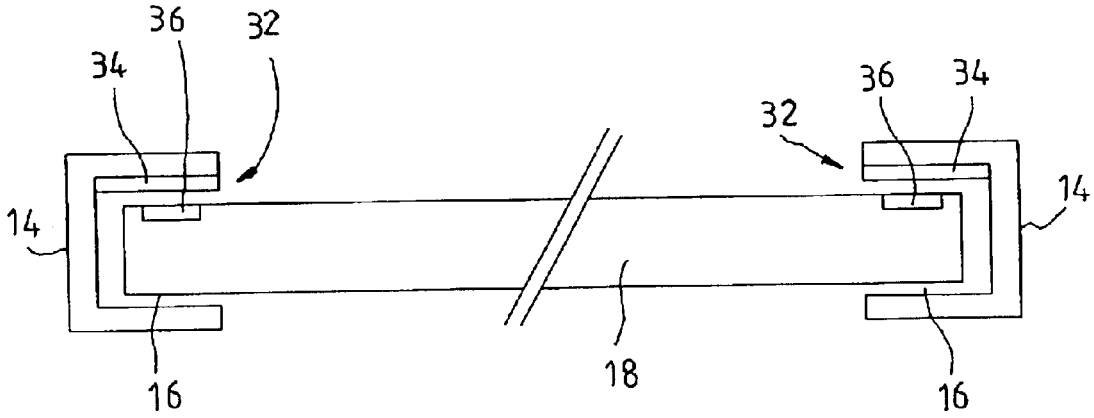
FIG. 4 is similar to FIG. 3 but showing the ends of the bottom rail disengaged from the side rails.

The two positioning mechanisms 32, as shown in FIGS. 3 and 4, each are comprised of a first magnetically attractive member 34 and a second magnetically attractive member 36. The first magnetically attractive member 34 is an iron bar fixedly fastened to the longitudinal sliding groove 16 of one side rail 14 at the backside. The length of the first magnetically attractive member 34 is equal to the length of the side rails 14. The second magnetically attractive member 36 is a block magnet fixedly fastened to the backside of the bottom rail 18 in a flush manner and disposed near one end of the bottom rail 18. Normally, the second magnetically attractive members 36 of the positioning mechanisms 32 at the ends of the bottom rail 18 are respectively secured to the first magnetically attractive members 34 inside the side rails 14 by magnetic attraction (see FIG. 3). When pulling the bottom rail 18 forwards, the second magnetically attractive members 36 of the positioning mechanisms 32 at the ends of the bottom rail 18 are disengaged from the first magnetically attractive members 34 inside the side rails 14 (see FIG. 4). At this time, the user can lift or lower the bottom rail 18 to the desired elevation. The side rails 14 can be directly made of magnetically attractive metal to attract the second magnetically attractive members 36 of the positioning mechanisms 32 at the ends of the bottom rail 18. In this case, the first magnetically attractive members 34 can be eliminated. In case the side rails 14 are made of plastics, wooden material, or aluminum, the installation of the first magnetically attractive members 34 in the side rails 14 is necessary. Further, the positions between the first magnetically attractive members 34 and the second magnetically attractive members 36 can be exchanged.

Figure 5:
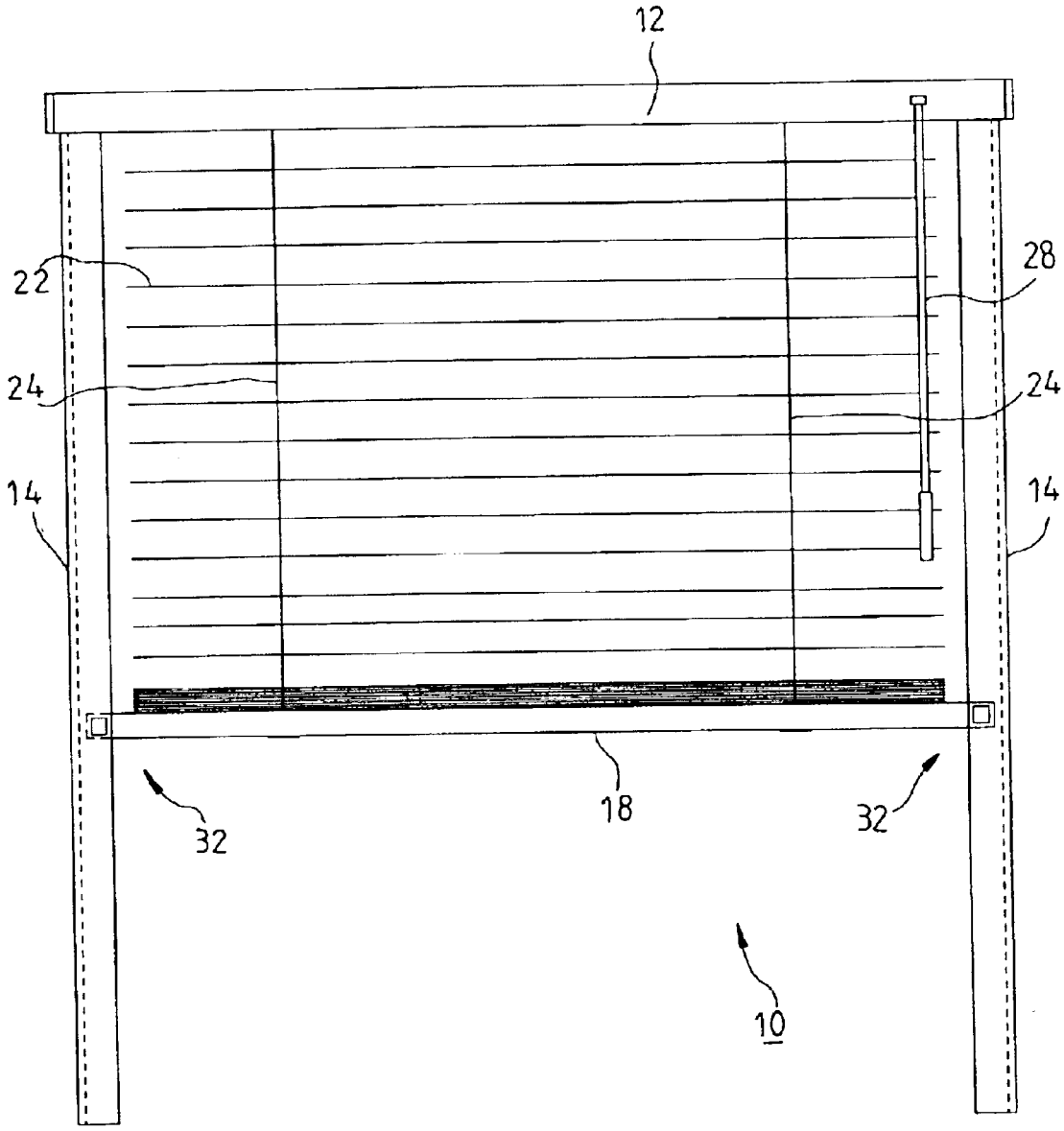
FIG. 5 is similar to FIG. 1 but showing the bottom rail of the Venetian blind positioned in a middle position.

According to the aforesaid structure, the user can pull the bottom rail 18 slightly forwards to disengage the second magnetically attractive members 36 of the positioning mechanisms 32 at the ends of the bottom rail 18 from the first magnetically attractive members 34 inside the side rails 14 (see FIG. 4), and then hold the bottom rail 18 in horizontal and move it to the desired elevation, and then push the bottom rail 18 backwards to force the second magnetically attractive members 36 of the positioning mechanisms 32 at the ends of the bottom rail 18 into engagement with the first magnetically attractive members 34 inside the side rails 14 by magnetic attraction (see FIG. 3), and therefore the bottom rail 18 is held firmly at the desired elevation, i.e. the Venetian blind 10 is held in the desired extended position as shown in FIG. 5.

The first magnetically attractive member is preferably a paramagnetic member, while the second magnetically attractive member is a magnet. Paramagnetic elements or compounds have unpaired electrons. The larger the number of unpaired electrons, the larger the magnetic force/moment.

As indicated above, the user can easily control the lifting and positioning of the Venetian blind.

In the aforesaid embodiment, the longitudinal sliding grooves 16 of the side rails 14 receive the ends of the bottom rail 18 and keep the bottom rail 18 in horizontal upon vertical movement of the bottom rail 18. Therefore, the side rails 14 prohibit the Venetian blind 10 from flying in the wind.

Figure 6:
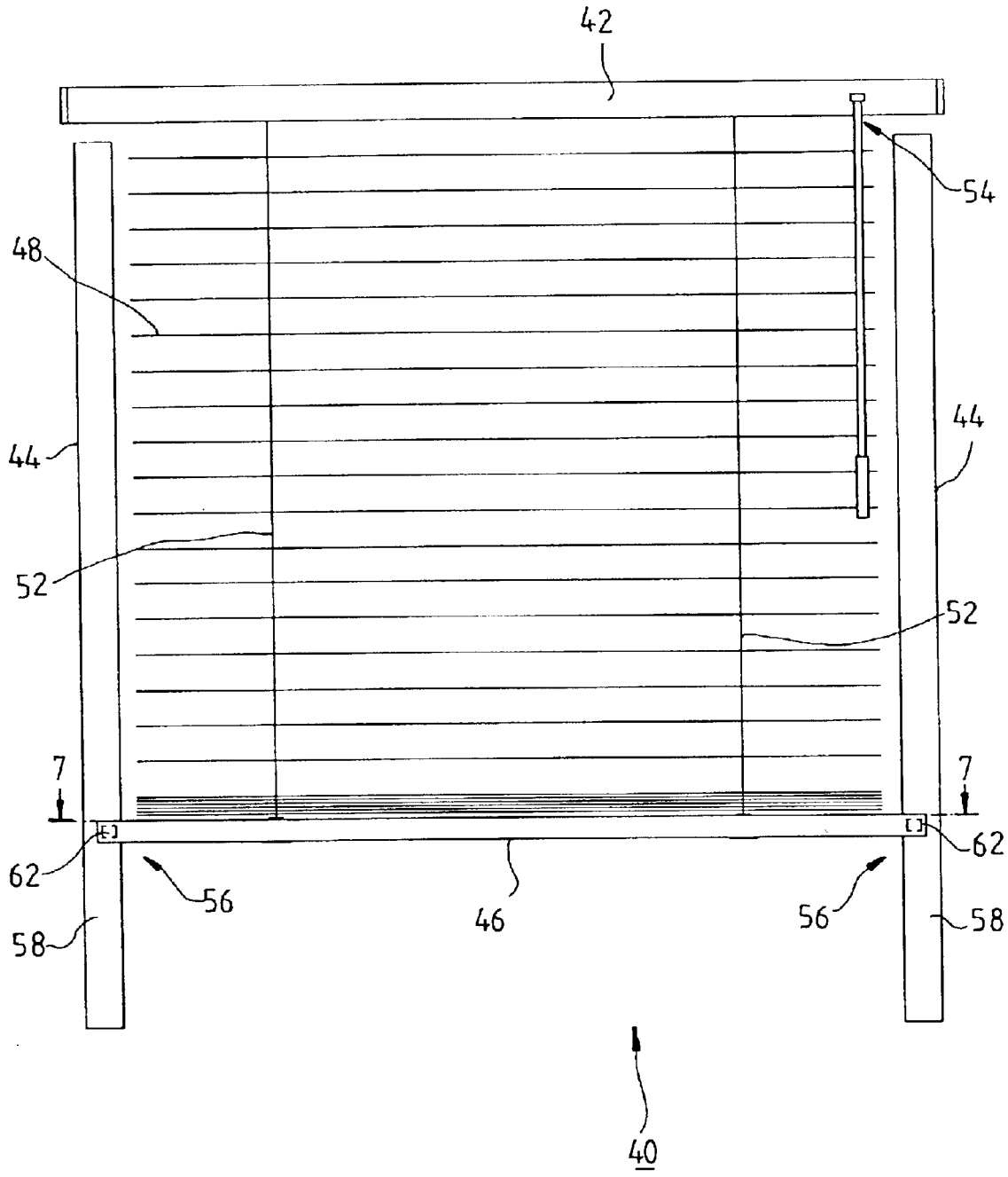
FIG. 6 is a front view of a Venetian blind according to the second preferred embodiment of the present invention.
Figure 7:
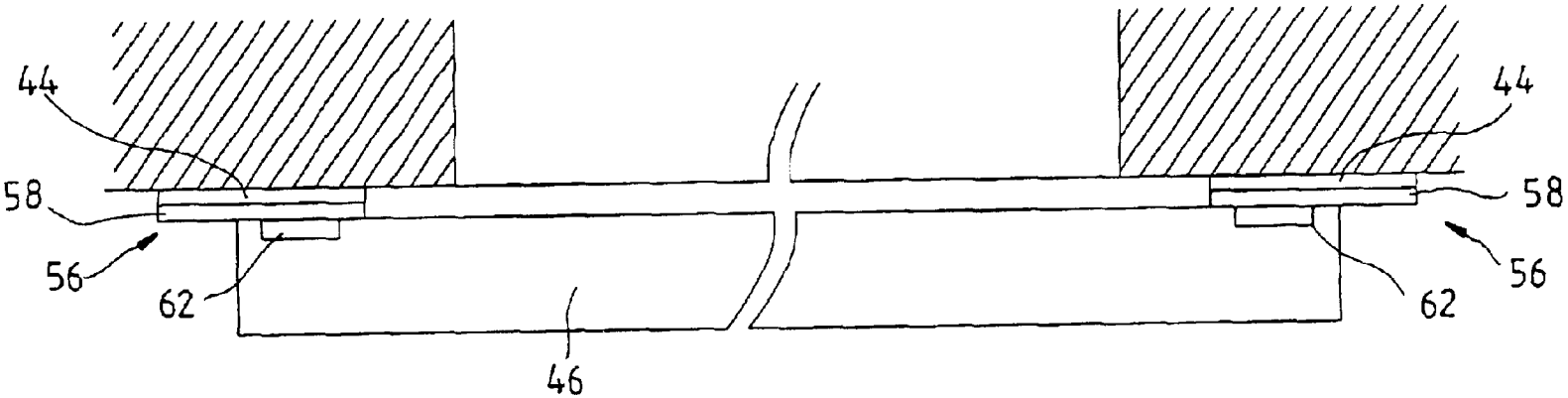
FIG. 7 is a sectional view taken along line 7—7 of FIG. 6, showing the ends of the bottom rail secured to the side rails.
Figure 8:
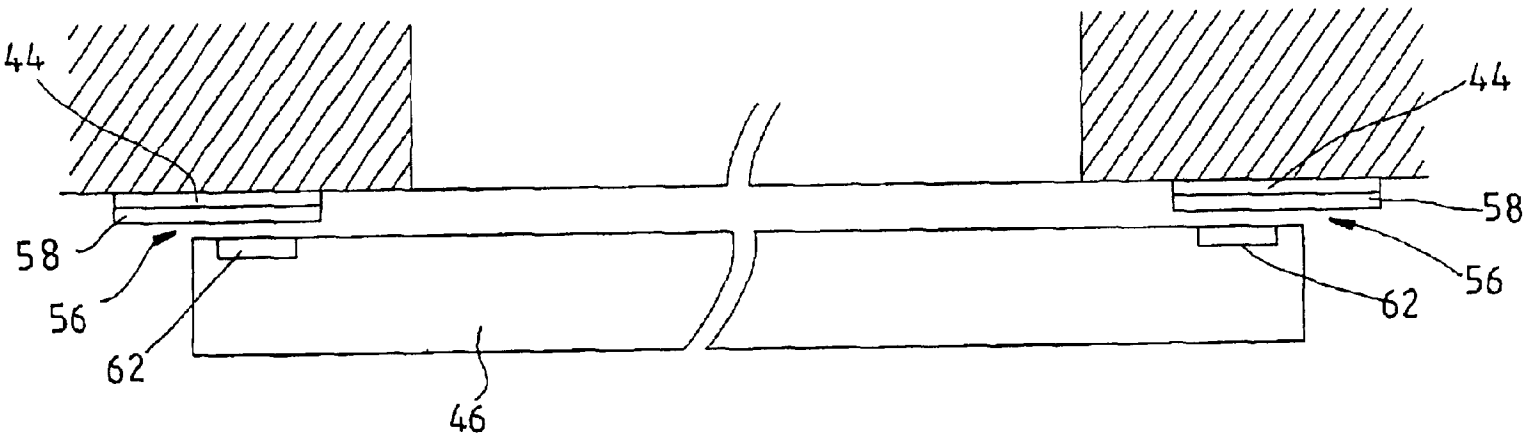
FIG. 8 is similar to FIG. 7 but showing the ends of the bottom rail disengaged from the side rails.

FIGS. 6~8 show a Venetian blind 40 constructed according to the second preferred embodiment of the present invention. According to this embodiment, the Venetian blind 40 comprises a headrail 42, two longitudinal side rails 44 bilaterally arranged in parallel below the headrail 42 and fixedly provided at the left and right sides of the window, a bottom rail 46 spaced below the headrail 42 and keeping the distal ends in front of the side rails 44, a set of slats 48 transversely (horizontally) arranged in parallel between the headrail 42 and the bottom rail 46, two connecting cords 52 bilaterally coupled between the headrail 42 and the bottom rail 46 and fastened to the slats 48 to hold the slats 48 in parallel, a tilting control mechanism 54 adapted to control tilting angle of the slats 48, and two positioning mechanisms 56. As shown in FIGS. 7 and 8, the positioning mechanisms 56 each are comprised of a first magnetically attractive member 58 fixedly located on one side rail 44 and the second magnetically attractive member 62 fixedly located on the bottom rail 46 and attractive to the first magnetically attractive member 58.

According to the aforesaid second embodiment, when the bottom rail 46 pushed backwards toward the wall, the bottom rail 46 is secured to the side rails 44 (see FIG. 7) and kept at the desired elevation. When adjusting the extending area of the Venetian blind 40, pull the bottom rail 46 forwards to disengage the second magnetically attractive member 62 from the first magnetically attractive member 58 (see FIG. 8), and then hold the bottom rail 46 in horizontal and move it to the desired elevation, and then push the bottom rail 46 backwards to force the second magnetically attractive member 62 into engagement with the first magnetically attractive member 58 (see FIG. 7) by magnetic attraction.

Figure 9:
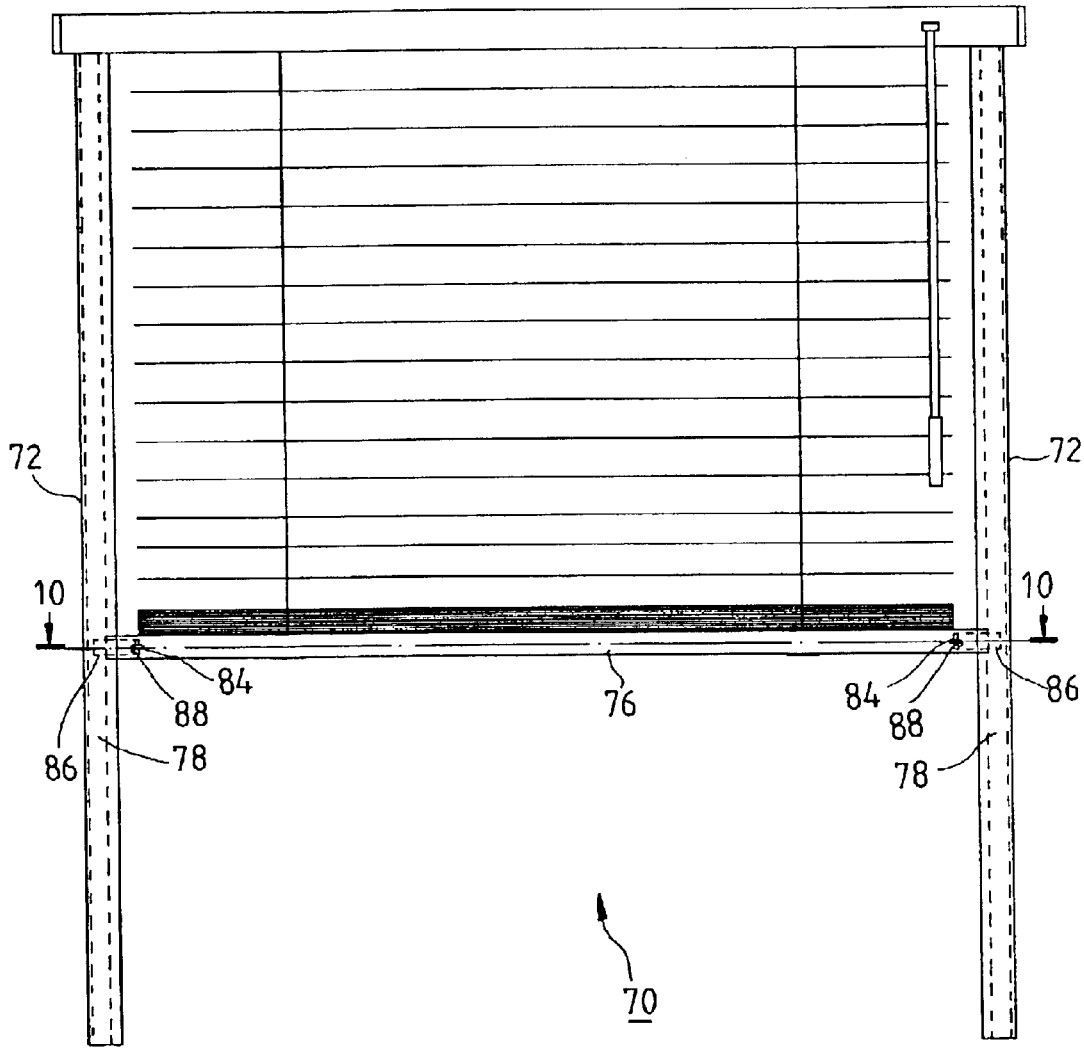
FIG. 9 is a front view of a Venetian blind according to the third preferred embodiment of the present invention.
Figure 10:
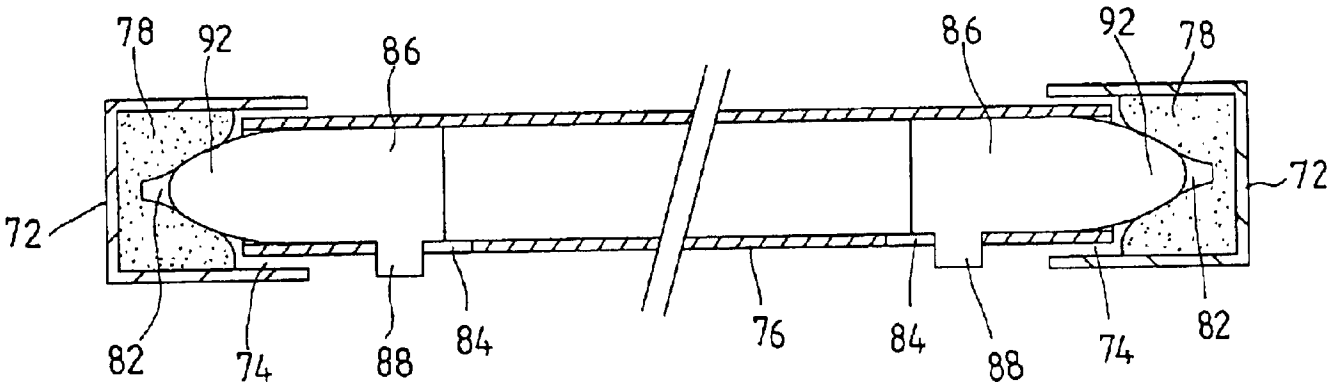
FIG. 10 is a sectional view taken along line 10—10 of FIG. 9 showing the ends of the bottom rail secured to the side rails.
Figure 11:
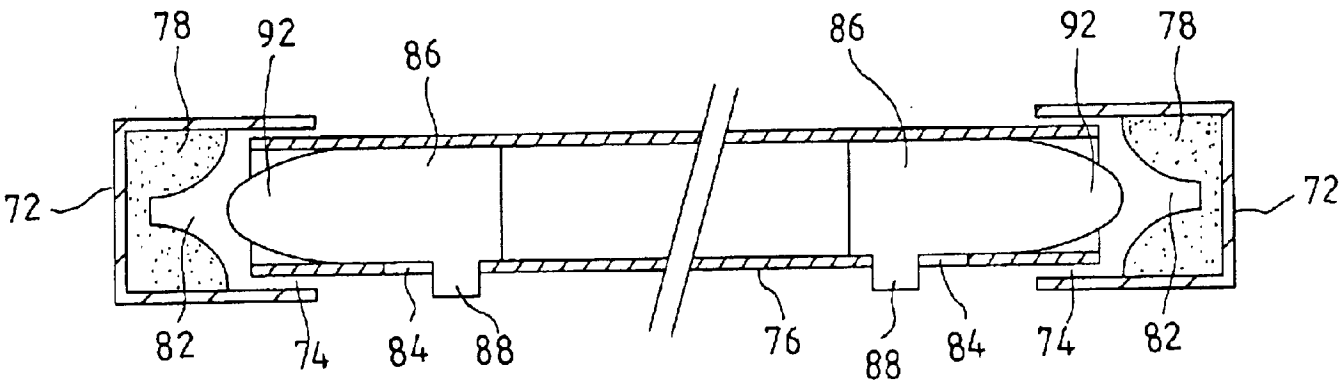
FIG. 11 is similar to FIG. 10 but showing the ends of the bottom rail disengaged from the side rails.
Figure 12:
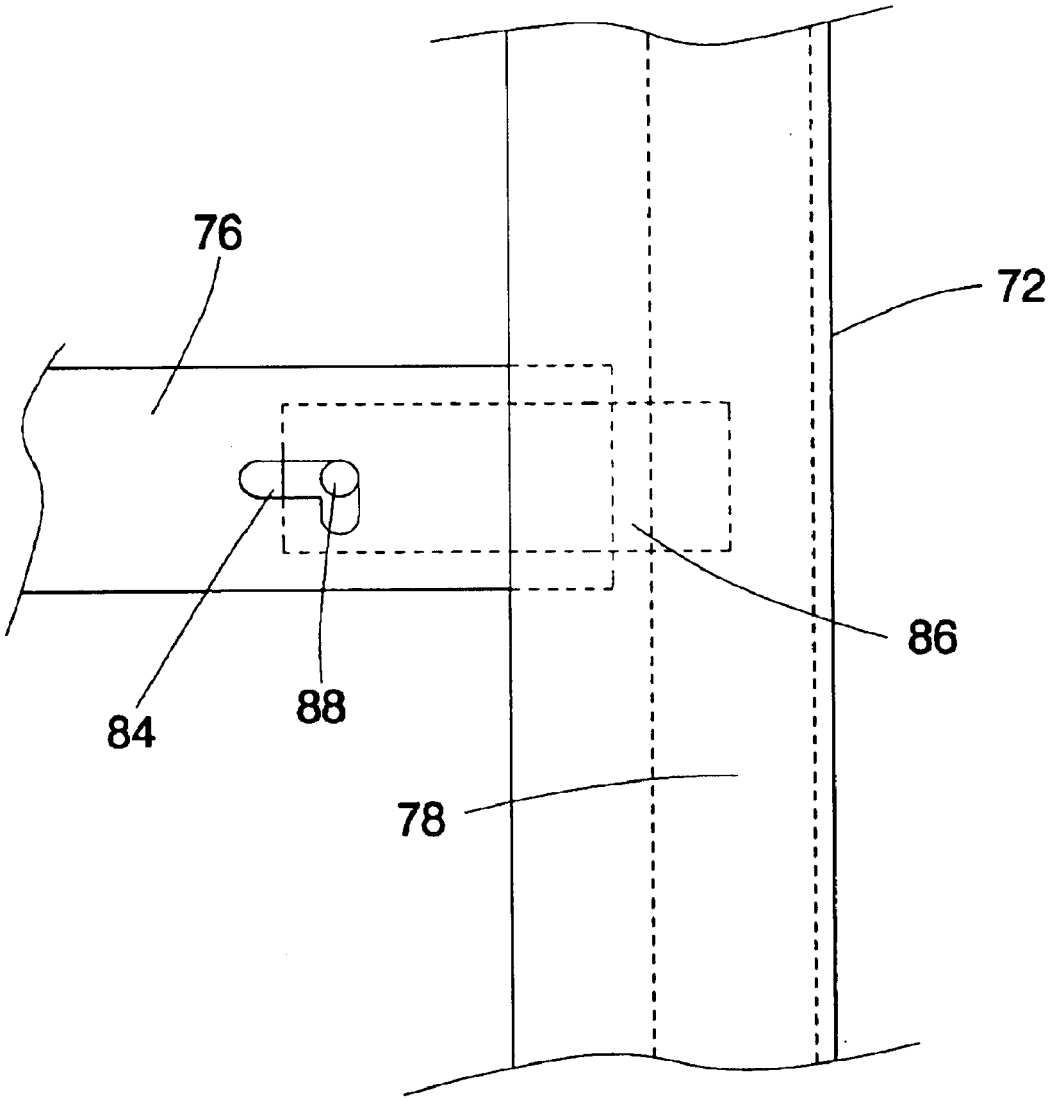
FIG. 12 is an enlarged view of a portion of FIG. 9.

FIGS. 9~11 show a Venetian blind 70 constructed according to the third preferred embodiment of the present invention. According to this embodiment, the side rails 72 each have a longitudinal sliding groove 74 facing each other to receive the ends of the bottom rail 72 and to guide vertical movement of the bottom rail 72, and a retaining packing strip 78 made of tough rubber and fixedly extended along the longitudinal sliding groove 74. The retaining packing strip 78 of each side rail 72 has a longitudinal retaining groove 82 facing the longitudinal open side of the respective side rail 72, i.e., the longitudinal retaining grooves 82 of the retaining packing strips 78 of the side rails 72 face the ends of the bottom rail 76. The longitudinal retaining groove 82 of each side rail 72 has a tapered cross section, i.e., the width of the retaining groove 82 gradually reduces from the outer open side toward the inner close side (according to this embodiment, the tapered cross section of the longitudinal retaining groove 82 of the retaining packing strips 78 of each side rail 72 has a hopper-like shape; alternatively, the longitudinal retaining groove 82 of each side rail 72 can be made having a wedge-like cross section). Further, the bottom rail 76 is a tubular member (or the solid member having two tubular ends), having two angled slots 84 respectively disposed near the two distal ends thereof (each angled slot 84 has a long longitudinal section and a short transverse section arranged at right angles). Further, two sliding locking members 86 are provided in the bottom rail 76 and moved in and out of the ends of the bottom rail 76. The sliding locking members 86 each has a handle 88 respectively extended through the angled slots 84 of the bottom rail 76, and a conical front engagement head 92 adapted to engage the longitudinal retaining grooves 82 of the retaining packing strips 78 of the side rails 72 respectively.

When the sliding locking members 86 extended out of the ends of the bottom rail 76 as shown in FIG. 10, the conical front engagement heads 92 of the sliding locking members 86 are respectively engaged into the longitudinal retaining grooves 82 of the retaining packing strips 78 of the side rails 72, and therefore the bottom rail 76 is secured to the side rails 72 at the desired elevation (when the handles 88 of the sliding locking members 86 moved into the short transverse sections of the angled slots 84 respectively, the sliding locking members 86 are held out of the ends of the bottom rail 76 in the locking position). When the sliding locking members 86 moved back in the ends of the bottom rail 76 as shown in FIG. 11, the conical front engagement heads 92 of the sliding locking members 86 are respectively disengaged from the longitudinal retaining grooves 82 of the retaining packing strips 78 of the side rails 72, and therefore the bottom rail 76 is disengaged from the constraint of the retaining packing strips 78 and allowed to be moved to the desired elevation. According to this embodiment, the retaining packing strip 78 in each side tail 71 forms with the corresponding sliding locking member 86 in the bottom rail 76 a positioning mechanism.

When adjusting the extending area of the Venetian blind 70, move the sliding locking members 86 back in the ends of the bottom rail 76, and then hold the bottom rail 76 in horizontal and move the bottom rail 76 to the desired elevation. When adjusted, the sliding locking members 86 are respectively extended out of the ends of the bottom rail 76 and engaged into the longitudinal retaining grooves 82 of the retaining packing strips 78 of the side rails 72 respectively.

Figure 13:
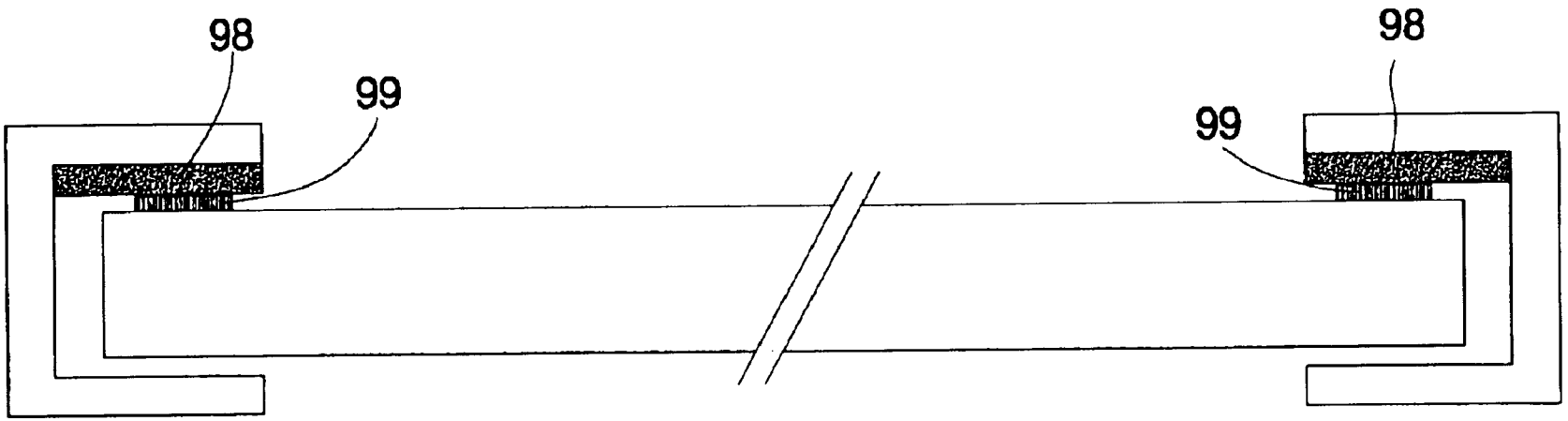
FIG. 13 shows the manner in which the end portions of the bottom rail are detachably secured to the side rails by hook and loop elements.

A tape of hook material 98 is fixedly provided at one end portion of the bottom rail 76 for fastening to a tape of loop material 99, as illustrated in FIG. 13.

Although particular embodiments of the invention have been described in detail for purposes of illustration, various modifications and enhancements may be made without departing from the spirit and scope of the invention. For example, hook and loop materials (Velcro) may be used instead of the aforesaid first magnetically attractive members and second magnetically attractive members. Accordingly, the invention is not to be limited except as by the appended claims.

What is claimed is:

1. A Venetian blind comprising:

a headrail extended in transverse direction;

two side rails longitudinally arranged in parallel at two sides below said headrail;

a bottom rail extended in transverse direction and spaced below said headrail and vertically movable along the length of said side rails, said bottom rail having two distal ends corresponding to said side rails;

a plurality of slats arranged in parallel between said headrail and said bottom rail;

at least two connecting cord members longitudinally connected to said slats and each having two ends respectively connected to said headrail and said bottom rail;

two positioning mechanisms provided between said side rails and said bottom rail and adapted to secure the two distal ends of said bottom rail to said side rails at the desired elevation; and wherein said side rails each have a longitudinal sliding grooves facing each other for receiving the two distal ends of said bottom rail and guiding vertical movement of said bottom rail; said positioning mechanisms each comprise a first magnetically attractive member fixedly fastened to the longitudinal sliding groove of one of said side rails and longitudinally extended along the respective longitudinal sliding groove, and a second magnetically attractive member fixedly fastened to one end of said bottom rail and adapted to attract said first magnetically attractive member.

2. A Venetian blind comprising:

a headrail extended in transverse direction;

two side rails longitudinally arranged in parallel at two sides below said headrail;

a bottom rail extended in transverse direction and spaced below said headrail and vertically movable along the length of said side rails, said bottom rail having two distal ends corresponding to said side rails;

a plurality of slats arranged in parallel between said headrail and said bottom rail;

at least two connecting cord members longitudinally connected to said slats and each having two ends respectively connected to said headrail and said bottom rail;

two positioning mechanisms provided between said side rails and said bottom rail and adapted to secure the two distal ends of said bottom rail to said side rails at the desired elevation; and wherein the two distal ends of said bottom rail are respectively disposed in front of said side rails; said positioning mechanisms each comprise a first magnetically attractive member fixedly fastened to a front side of one of said side rails and longitudinally extended along the respective side rail, and a second magnetically attractive member fixedly fastened to a back side of one end of said bottom rail and adapted to attract said first magnetically attractive member.

3. The Venetian blind as claimed in claim 1 or claim 2, wherein said first magnetically attractive member is a paramagnetic metal member, and said second magnetically attractive member is a magnet.

4. A Venetian blind comprising:

a headrail extended in transverse direction;

two side rails longitudinally arranged in parallel at two sides below said headrail;

a bottom rail extended in transverse direction and spaced below said headrail and vertically movable along the length of said side rails, said bottom rail having two distal ends corresponding to said side rails;

a plurality of slats arranged in parallel between said headrail and said bottom rail;

at least two connecting cord members longitudinally connected to said slats and each having two ends respectively connected to said headrail and said bottom rail;

two positioning mechanisms provided between said side rails and said bottom rail and adapted to secure the two distal ends of said bottom rail to said side rails at the desired elevation; and wherein said side rails are magnetically attractive members, each having a longitudinal sliding groove facing each other; the two distal ends of said bottom rail are respectively inserted into the longitudinal sliding grooves of said side rails to guide vertical movement of said bottom rail; said positioning mechanisms each comprise a magnet respectively fixedly fastened to the two distal ends of said bottom rail for enabling said bottom rail to be secured to said side rail by magnetic attraction.

5. A Venetian blind comprising:

a headrail extended in transverse direction;

two side rails longitudinally arranged in parallel at two sides below said headrail;

a bottom rail extended in transverse direction and spaced below said headrail and vertically movable along the length of said side rails, said bottom rail having two distal ends corresponding to said side rails;

a plurality of slats arranged in parallel between said headrail and said bottom rail;

at least two connecting cord members longitudinally connected to said slats and each having two ends respectively connected to said headrail and said bottom rail;

two positioning mechanisms provided between said side rails and said bottom rail and adapted to secure the two distal ends of said bottom rail to said side rails at the desired elevation; and wherein said side rails are magnetically attractive members; the two distal ends of said bottom rail are disposed in front of said side rails; said positioning mechanisms each comprise a magnet respectively fixedly fastened to the two distal ends of said bottom rail for enabling said bottom rail to be secured to said side rail by magnetic attraction.

6. A Venetian blind comprising:

a headrail extended in transverse direction;

two side rails longitudinally arranged in parallel at two sides below said headrail;

a bottom rail extended in transverse direction and spaced below said headrail and vertically movable along the length of said side rails, said bottom rail having two distal ends corresponding to said side rails;

a plurality of slats arranged in parallel between said headrail and said bottom rail;

at least two connecting cord members longitudinally connected to said slats and each having two ends respectively connected to said headrail and said bottom rail;

two positioning mechanisms provided between said side rails and said bottom rail and adapted to secure the two distal ends of said bottom rail to said side rails at the desired elevation; and wherein said side rails each have a longitudinal sliding groove facing each other and adapted to receive the two distal ends of said bottom rail and to guide vertical movement of said bottom rail; said positioning mechanisms each comprise an elastic retaining packing strip and a sliding locking member, said retaining packing strip being longitudinally fixedly provided in the longitudinal sliding groove of one of said side rails, said retaining packing strip having a longitudinal retaining groove, said longitudinal retaining groove having a longitudinal open side facing one end of said bottom rail and a tapered cross section gradually reducing from said longitudinal open side toward an inner side of the longitudinal retaining groove of said retaining packing strip, said sliding locking member being slidably mounted in said bottom rail and moved in and out of one end of said bottom rail, said sliding locking member having a front engagement head, which engages the longitudinal retaining groove of said retaining packing strip when said sliding locking member extended out of one end of said bottom rail.

7. The Venetian blind as claimed in claim 6, wherein the two distal ends of said bottom rail are tubular ends, each having an angled slot, said angled slot having a long longitudinal section and a short transverse section arranged at right angles; the sliding locking members of said positioning mechanisms are respectively mounted in the tubular ends of said bottom rail, each having a handle respectively extended out of the angled slots of the tubular ends of said bottom rail for operation by the user to move said sliding locking members in and out of the tubular ends of said bottom rail.

8. A Venetian blind comprising:

a headrail extended in transverse direction;

two side rails longitudinally arranged in parallel at two sides below said headrail;

a bottom rail extended in transverse direction and spaced below said headrail and vertically movable along the length of said side rails, said bottom rail having two distal ends corresponding to said side rails;

a plurality of slats arranged in parallel between said headrail and said bottom rail;

at least two connecting cord members longitudinally connected to said slats and each having two ends respectively connected to said headrail and said bottom rail;

two positioning mechanisms provided between said side rails and said bottom rail and adapted to secure the two distal ends of said bottom rail to said side rails at the desired elevation; and wherein said side rails each have a longitudinal sliding groove; the two distal ends of said bottom rail are respectively received in the longitudinal sliding grooves of said side rails; said positioning mechanisms each comprise a tape of loop material longitudinally fixedly provided in the longitudinal sliding groove of one of said side rails, and a tape of hook material fixedly provided at one end of said bottom rail for fastening to said tape of loop material.

* * * * *